United States Patent [19]

Raschle

[11] 4,033,106

[45] July 5, 1977

[54] FRICTION DISC FOR DRIVING TWIST TUBES ROTATING AT HIGH SPEEDS

[75] Inventor: Josef Raschle, Butschwil, Switzerland

[73] Assignee: Heberlein & Co. AG, Switzerland

[22] Filed: Oct. 28, 1975

[21] Appl. No.: 626,543

[30] Foreign Application Priority Data

Dec. 4, 1974 Switzerland ..... 16069/74

[52] U.S. Cl. ..... 57/77.45; 74/206; 74/216

[51] Int. Cl.[2] ..... D01H 1/243

[58] Field of Search ..... 57/77.45; 74/206, 210, 74/215, 216

[56] References Cited

UNITED STATES PATENTS

| | | | |
|---|---|---|---|
| 2,855,750 | 10/1958 | Schrenk et al. | 57/77.45 X |
| 3,133,449 | 5/1964 | Van Antwerp et al. | 74/216 |
| 3,458,985 | 8/1969 | Richter | 57/77.45 |
| 3,613,467 | 10/1971 | Lee | 57/77.45 X |
| 3,821,905 | 7/1974 | Chesmer et al. | 74/216 |
| 3,827,229 | 8/1974 | Bieniok | 57/77.45 |

*Primary Examiner*—Richard C. Queisser
*Assistant Examiner*—Charles Gorenstein
*Attorney, Agent, or Firm*—Larson, Taylor and Hinds

[57] ABSTRACT

Friction discs for use in driving of guide rollers for twist tubes in false twist devices for texturing synthetic filaments are described in which the disc comprises a support disc of non-resilient material surrounded by a friction ring of synthetic resilient material that is tapered radially outward to the circumferential surface making contact with the twist tube. This enables the friction discs to be spaced more closely together in the roller and shorter twist tubes to be used. Centrifugal force on the friction ring is also reduced. Higher rotation speed are, therefore, achieved. The ratio of the width of the inner circumferential surface of the friction ring to the width of its surface engaging the twist tube is between 1.5:1 and 3:1. The support disc may be of metal alloy or consist of an inner disc of synthetic plastics material with an outer ring of metal alloy. In each case the metal alloy should have a modulus of elasticity of at least 6500 kp/mm² and a tensile strength of at least 25 kp/mm².

5 Claims, 3 Drawing Figures

FRICTION DISC FOR DRIVING TWIST TUBES ROTATING AT HIGH SPEEDS

FIELD OF THE INVENTION

The present invention relates to a friction disc for use in a driving assembly for a twist tube in a false-twist device for texturing synthetic filaments. The invention also relates to rollers which incorporate such friction discs and which rotate at high revolution speeds.

DESCRIPTION OF THE PRIOR ART

False twist devices are known which comprise, in a wedge-shaped throat between two axially parallel rollers, a twist tube supported in tangential contact with friction discs, constituting parts of the rollers. One of the rollers is driven and the other idles as a guide roller. The twist tube is preferably pressed against the rollers by magnetic means. The friction discs may consist of one piece which may be of resilient synthetic material, especially polyurethane. Furthermore, friction discs consisting of two parts are also used which comprise a support of a material of low resiliency and of relatively high solidity, for example of a suitable synthetic plastics material or metal and with a friction ring of resilient synthetic material, particularly polyurethane. An essential problem with such friction discs is that, because of the centrifugal forces due to the high revolution speeds, undesirable forces due to high revolution speeds, undesirable deformation of the discs may appear.

The development of false twist texturing devices tends to achieve higher and higher revolution speeds of the twist tube, so as to increase the production quantity of textured yarns. An essential condition for achieving the revolution speeds of up to 1 million r.p. m. required nowadays consists in using twist tubes which are as short as possible, the increased rigidity of which causes the resonance frequency to be high and thus increases the critical revolution speed.

SUMMARY OF THE INVENTION

It is the purpose of the present invention to provide a form of friction disc for driving twist tubes which renders possible the use of short twist tubes and in which, at the same time, the danger is reduced of undesirable deformations or of destruction because of the centrifugal forces due to extremely high revolution speeds.

Accordingly, the object of the present invention consists in a friction disc for driving twist tubes of a false twist device for texturing synthetic yarns, rotating at high revolution speeds, consisting of a support disc composed at least of one non-resilient material and of a friction ring of resilient synthetic material forming the rim of the friction disc, the friction ring being tapered towards its surface of contact with the twist tube from the inner surface of the ring. The ratio between the width of the inner circumferential surface of the friction ring and the width of its contact surface is preferably between 1.5 : 1 and 3 : 1, particularly 2 : 1.

The feature of the present invention makes it possible for the two friction discs, forming the driving roller or the guide roller, respectively, to be closer to each other wherefore shorter twist tubes can be used. It is essential for the aforesaid ratio between the width of the inner circumferential surface and the width of the contact surface of the friction ring to be chosen large enough for lateral tilting of the shortened twist tube to be avoided even with very high forces pressing the twist tube against the rollers. The choice of a base or inner circumferential surface as large as possible with respect to the width of the contact surface furthermore has the advantage that the traction forces appearing on the contact surface of the disc under the effect of the centrifugal forces are much reduced per unit surface area whereby the danger of deformation and even of destruction of the friction ring at very high disc revolution speeds is much reduced.

DESCRIPTION OF THE DRAWINGS

In order that the invention may be clearly understood and readily carried into effect two driving rollers in accordance therewith will now be described by way of example, with reference to the accompanying drawings, in which.

Figure 1:
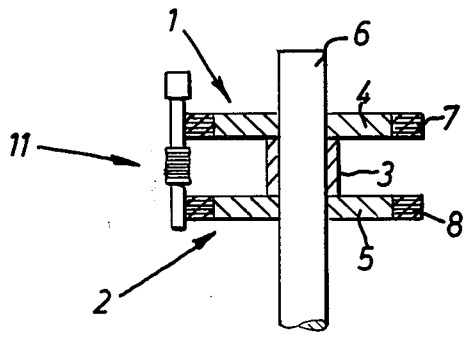
FIG. 1 shows a central longitudinal section through a known driving roller in contact with a twist tube.

The known form of driving roller shown in FIG. 1 consists of two friction discs 1, 2 which are kept apart by means of a spacer tube 3. Each friction disc comprises a circular support disc 4 or 5 pressed onto a steel shaft 6. The support discs 4, 5 consist of metal and have a diameter of 30 mm and a thickness of 4 mm. Each support disc is rigidly connected to a friction ring 7 or 8 of polyurethane by means of a bonding agent and an adhesive, the inner circumferential surface of the friction ring 7 or 8 corresponding exactly to the outer circumferential surface of the associated support disc 4 or 5. The friction rings 7, 8 have an outer diameter of 40 L mm, and the width of its contact surfaces is 4 mm. A twist tube 11 is applied to the contact surfaces of the friction rings 7, 8. A guide roller also forming part of a false twist device, shaped similarly to the driving roller is not shown. The steel shaft 6 can be driven in a manner not shown.

Figure 2:
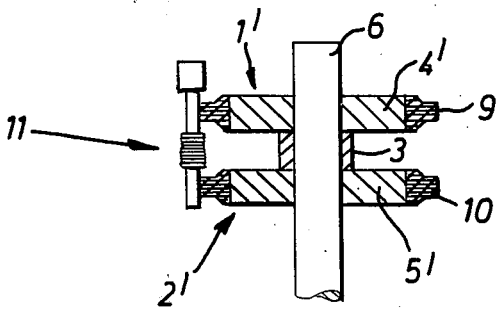
FIGS. 2 and 3 each show a central longitudinal section through a driving roller according to the present invention in contact with a twist tube.

In the driving roller shown in FIG. 2, which is constructed according to the invention friction discs 1', 2', consist of the same materials as in the rollers of FIG. 1, and the friction discs 4',5' have the same diameter, but a thickness of 6 mm. The friction rings 9, 10 forming the disc rims are tapered towards the contact surface with the twist tube 11, the inner circumferential surface having a width of 6 mm and the contact surface a width of 3 mm. As can easily be seen, this form of the friction discs 1', 2' makes possible a reduction of the length of the twist tube 11 by 2 mm which is of extreme importance for obtaining critical revolution speeds which are as high as possible in view of the fact that the deflection of the twist tube varies as the third power of the length variations.

The ratio between the width of the inner circumferential surface and the width of the contact surface of the friction rings 9, 10 is 2 : 1 and is sufficient to ensure that tilting of the tapered portion does not take place even with very high forces pressing the twist tube against the friction discs 1', 2'.

In order to achieve a revolution speed of the twist tube 11 of 1 million r.p.m., the shaft 6 must be driven, for the given dimensions of the friction discs 1', 2' at 50,000 r.p.m. At this speed, the known form of driving roller of FIG. 1 is subjected at the inner circumferential surfaces of the friction rings 7, 8 in contact with support disc 4, 5 to a force of approximately 36 kp/cm$^2$ (kiloponds per square centimeter) which means considerable danger of destruction of the friction rings. In the driving roller of FIG. 2, however, the inner circumferential surfaces of the friction rings 9, 10 in contact with support discs 4', 5' are subjected to a force of only 26. 6 kp/cm² whereby the danger either of deformation of destruction of the friction rings is much reduced.

Figure 3:
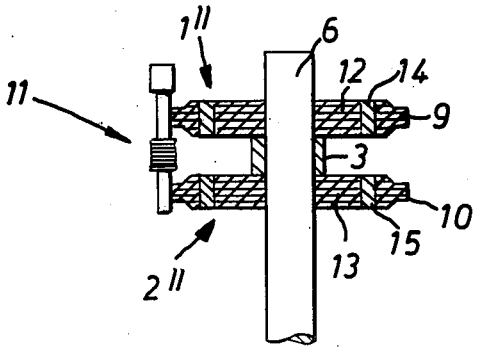

FIG. 3 shows a modified form of the driving roller of FIG. 2 in which friction discs 1'', 2'' each consist of three parts, each of them consisting of a disc 12 or 13 of a synthetic material of low resiliency and of relatively high solidity, for example polyacetal resin, a metal ring 14 or 15 fixed to the associated disc 12 or 13 and a friction ring 9 or 10 similar to those in the example shown in FIG. 2. All three parts of the friction discs 1'', 2'' are fixed to each other by bonding agents and/or adhesives.

The friction discs constructed according to FIG. 3 have the advantage that their mass is essentially smaller with respect to support discs consisting entirely of metal and that, accordingly, the critical revolution speed of the shaft, together with the whole driving rollers, is essentially higher. The width of the metal rings 14, 15 between the inner and outer circumferential surface is chosen so that the necessary traction force is assured in association with high revolution speeds and, in the example of FIG. 3 is approximately 3 mm. If the twist tube is pressed against the contact surfaces of the friction rings, by means of a magnet, because of the smaller metal content of the discs, lower eddy current losses are observed. As metals for the support discs in the friction discs shown in FIGS. 2 and 3, metal alloys with a modulus of elasticity of at least 6500 kp/cm² and a tensile strength of at least 25 kp/mm² come primarily into consideration, particularly aluminium alloys, titanium alloys and chrome - nickel steel alloys. The two last-mentioned metal alloys furthermore have a very high specific resistance so that, when using magnets as the means for pressing the twist tubes against the friction discs, the eddy current losses are relatively low.

I claim:

1. A friction disc for using in a driving assembly for a twist tube in a false twist device for texturing synthetic filaments, wherein the twist tube is driven at high speed in contact with the edge of the friction disc, the friction disc comprising a support disc symmetrical about a central axis and having a peripheral surface of uniform axial width, said support disc comprising at least one non-resilient material and being formed for axial mounting on means for rotating the friction disc about said axis, and a friction ring of resilient synthetic material having an inner circumferential surface fixed to and substantially covering said peripheral surface of said support disc, and having an outer circumferential driving surface of less axial width than said peripheral surface and providing the edge for contact with the twist tube, said friction ring being tapered on all radii about said axis from said inner circumferential surface to said outer circumferential surface and said friction ring being symmetrical with respect to a median plane of the disc extending parallel to the plane of the disc.

2. A friction disc according to claim 1, wherein said inner circumferential surface and said outer circumferential surface are parallel to one another and the ratio of the width of said inner circumferential surface to the width of said outer circumferential is between 1.5:1 and 3:1.

3. A friction disc according to claim 1 wherein said support disc comprises an inner disc of a synthetic plastic material and an outer cylindrical ring of a metal alloy having a modulus of elasticity of at least 6500 kp/mm² and a tensile strength of at least 25kp/mm², said alloy being selected from the group consisting of an aluminium alloy, a titanium alloy and a chrome-nickel alloy, and said cylindrical ring being fixed to the periphery of said inner disc.

4. A driving roller for use in a driving assembly for a twist tube in a false twist device for texturing synthetic filaments, wherein the twist tube is driven at high speed in contact with the roller, the roller comprising two similar and parallel friction discs and an intervening tube spacing said friction discs apart, said discs and tube being adapted for mounting co-axially on a rotary shaft, each friction disc comprising a support disc arranged to lie symmetrically about said shaft and having a peripheral surface of uniform axial width, said support disc comprising at least one non-resilient material and each friction disc further comprising a friction ring of resilient synthetic material having an inner circumferential surface fixed to and substantially covering the peripheral surface of the support disc in the friction disc and having an outer circumferential surface of less axial width than the peripheral surface of the associated support disc and providing an edge for contact with the twist tube, each said friction ring being radially tapered all around the friction ring from said inner circumferential surface to said outer circumferential surface, to present similar inclined surfaces on said ring converging to said outer circumferential surfaces and the ratio of the width of the inner circumferential surface to the width of the outer circumferential surface being between 1.5:1 and 3:1, each said friction ring being symmetrical with respect to a median plane of the associated friction disc extending parallel to the plane of said friction disc.

5. A driving roller according to claim 4, wherein each said support disc at least partially comprises a metal alloy with a modulus of elasticity of at least 6500 kp/mm² and a tensile strength of at least 25 kp/mm², each said support disc further comprising an inner disc of synthetic plastics material and an outer ring of said metal alloy fixed to the periphery of said inner disc.

* * * * *